United States Patent [19]

Moss

[11] 4,245,615

[45] Jan. 20, 1981

[54] MODULAR RANGE CONSTRUCTION

[75] Inventor: Harold J. Moss, Cleveland, Tenn.

[73] Assignee: Magic Chef, Inc., Cleveland, Tenn.

[21] Appl. No.: 34,737

[22] Filed: Apr. 30, 1979

[51] Int. Cl.[3] ..... A21B 1/00

[52] U.S. Cl. ..... 126/273 R; 126/19 R

[58] Field of Search ..... 126/21, 19, 19.5, 273, 126/273 A, 21 A

[56] References Cited

U.S. PATENT DOCUMENTS

| | | | |
|---|---|---|---|
| 3,033,188 | 5/1962 | Cline et al. | 126/273 |
| 3,387,601 | 6/1968 | Buerki et al. | 126/21 R |
| 3,402,281 | 9/1968 | Vonderhaar | 126/21 R |
| 3,553,425 | 1/1971 | Fry | 126/21 R |

*Primary Examiner*—Samuel Scott

*Assistant Examiner*—Wesley S. Ratliff, Jr.

*Attorney, Agent, or Firm*—Bacon & Thomas

[57] ABSTRACT

A cooking range has a pair of side panels as its main structural members. A range top, back panel, bottom member and oven frame are all secured to the side panels and a heat insulated oven shell having an open front is supported at its forward end by the oven frame and by spaced brackets engaging the back panel. Heat conductive contact between the oven shell and oven frame, between the oven frame and side panels and between inner and outer walls of the side panels is minimized by forming upstanding pads on one of each of the pairs of members and through which suitable fastening means extend. The pads are of small area and are the only portions of the members that are in direct contact.

9 Claims, 5 Drawing Figures

MODULAR RANGE CONSTRUCTION

BACKGROUND OF THE INVENTION

This invention is in the field of cooking ranges principally for domestic use.

It has been customary in the manufacture of cooking ranges to design each style or model of range separately and to manufacture or produce all of the various pieces and parts designed especially for that particular model and it has been found that upon change of a design or model many and a multitude of changes in the structure or dimensions of the parts was necessary. This imposed a heavy expense on the manufacturer since he had to retool for each part of each different model.

SUMMARY OF THE INVENTION

The present invention is in the nature of a modular construction for cooking ranges which involves the design and manufacture of certain standardized parts or modules that may be used in many different models of ranges whether they be gas or electric. Thus, it is necessary to redesign and make only those elements that are necessarily different in the different models or types of range.

It is therefore a principal object of this invention to provide a cooking range structure employing a maximum number of standardized parts that can be used in many different models or designs.

DESCRIPTION OF THE PREFERRED EMBODIMENT

Figure 3:
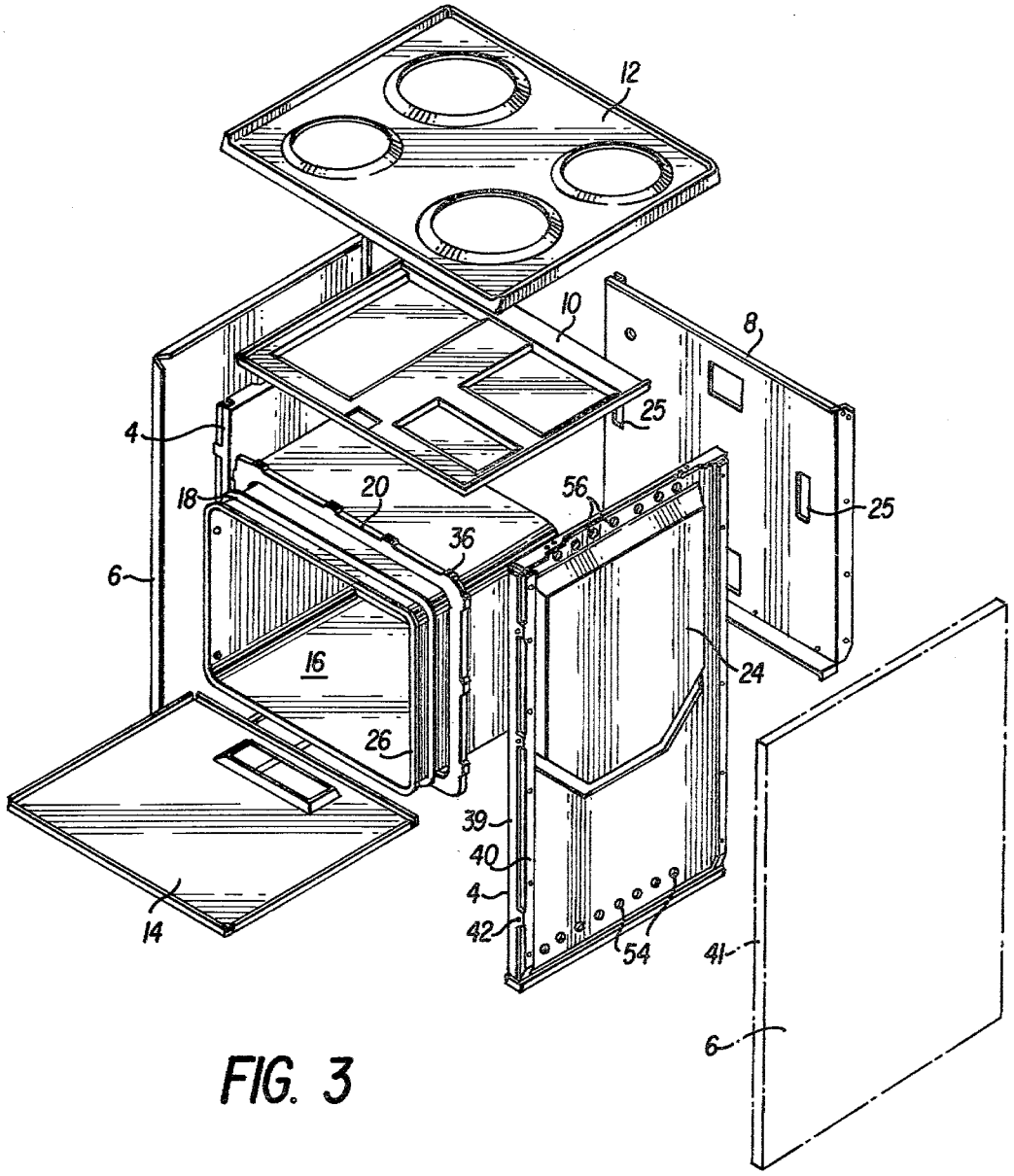
FIG. 3 is an exploded view indicating the relationship and general structure of the basic parts.
Figure 4:
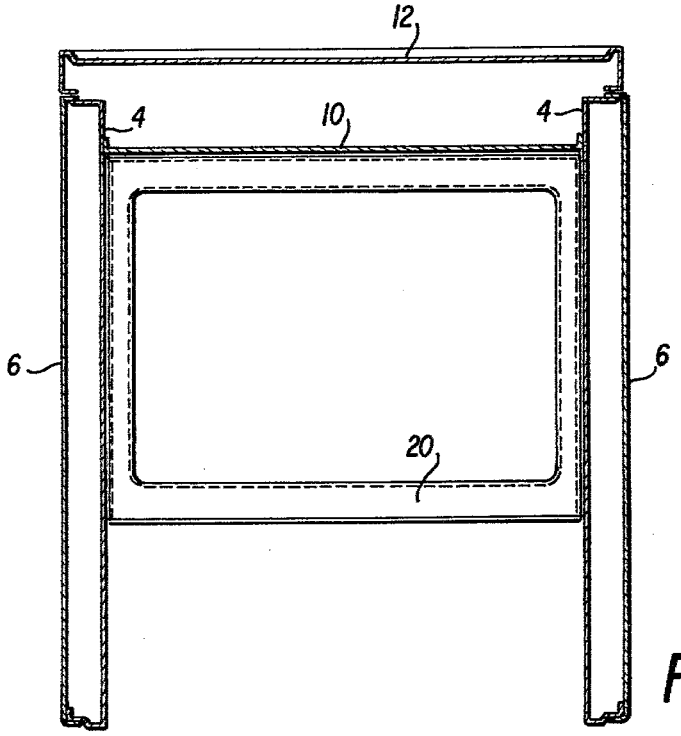
FIG. 4 is a schematic transverse sectional and schematic view through a representative range of the present invention, looking forwardly.

Referring first to FIGS. 3, 4 and 6 are, respectively, inner and outer metal panel sheets which, when secured together, comprise side panels forming the main structural elements of the range. The panels 4 and 6 will be assembled in the manner to be described and placed in position to constitute the lateral sides of the range. A back panel 8 is then secured to the two side panels 4–6 extending therebetween to define the back of the range. A fire box bottom panel 10 likewise extends between the side panels 4–6 and is secured thereto, and a range top member 12 can be placed on and secured to the top edges of the side panels to extend thereacross and define the range top.

Herein the reference to a range top will make reference to either the panels 10 or 12 or a combination of both panels.

At a lower level in the range structure, a bottom member 14 is also positioned to extend between and be secured to the side panels 4–6. When the parts thus far described are assembled, they will define a box-like enclosure comprising the side panels, rear panel, top members and bottom member 14. In that box-like structure, an oven shell 16 is positioned. The oven shell 16 is smaller than the space it is placed in, and is surrounded by thermal insulation 18 (see FIGS. 1 and 2). The shell 16 defines the oven cavity closed by a rear wall, not shown, and has an open front.

An oven front framing member 20 is positioned between and secured to the side panels 4–6 and is of generally rectangular shape having a framed opening into which the oven shell 16 is inserted. The oven framing member 20 is secured to the side panels 4–6 and to the oven shell, and constitutes the main support for the oven shell when the range is assembled. The oven shell comprising the inner metal member 16 and its insulation 18 is designated in FIG. 5 generally by the numeral 22, and it will be seen from that figure that the oven structure is supported mainly by the front framing member 20, and is spaced from all sides and the rear of the box defined by the previously described side, top and bottom members. The rear of the oven shell has brackets 23 (see FIG. 5) welded or otherwise secured to its sides and which extend into flanged openings 25 in back panel 8 (or 58), to help support the oven shell. Due to the small area of contact between brackets 23 and panel 8 (or 58) no significant heat transfer takes place from the oven shell to panel 8 (or 58). This provides good heat isolation of the oven from the remainder of the structure.

Numeral 24 designates a pocket formed in panel 4 to provide a dead air space covering an area substantially coextensive with a side of the oven 22. Thus reducing thermal conduction between the oven and the sides of the range. If desired loosely compacted mineral wool may be placed in the pocket 24.

Figure 2:
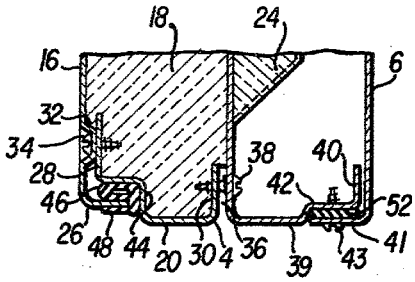
FIG. 2 is an enlarged fragmentary sectional view taken on the line 2—2 of FIG. 1.

Referring now particularly to FIG. 2, it will be seen that the metal oven shell 16 is provided with a forward outwardly directed flange 26 defining and framing the open front of the oven shell. The framing member 20 is in the form of a generally U-shaped channel member, in transverse section, having an inner flange 28 and outer flange 30. The oven shell 16 is spaced somewhat from the flange 28 and its flange 26 is likewise spaced from the framing member. The oven shell is provided with spaced outwardly struck pad portions 32 which are the only portions of that shell that make metal-to-metal contact with the framing member 20. The pads 32 are of very small area, and through which fastening members such as sheet metal screws 34 extend to hold the parts in assembled relation.

The outer flange 30 of framing member 20 is spaced from the inner panel member 4 and is also provided with spaced outwardly struck pad members 36 which are the only parts thereof that come into metal-to-metal contact with panel member 4. Here again, fastening screws 38 extend through the panel member 4 and the pads to hold the parts in assembled relation. As evident from FIGS. 1 and 3 pads 36 are also provided along the top of frame member 20 so that only limited contact exists between members 20 and 10.

The inner panel member 4 has a front edge portion defined by a lateral flange 39 and an inwardly extending peripheral flange 40 overlapping but spaced from side panel member 6 and its peripheral flange 41 and not in contact therewith. The flange 39 of panel member 4 is also provided with isolated pad regions 42 (see FIG. 3) that are the only parts thereof making metal-to-metal contact with the outer panel member 6. Sheet metal screws 43 hold these parts in assembled relation.

The front portion of framing member 20 is provided with a re-entrant rabbet 44 into which the front flange 26 of the oven shell is directed. A body of thermal insulating material 46, preferably resilient, is positioned in that rabbet and makes contact with the flange 26 and the rabbet 44, but holds the metal portions of shell 16 and framing member 20 separated and out of heat conducting contact with each other. The member 46 has a front portion 48 extending along the outer face of the flange 26 and defines a peripheral seal around the oven opening to be engaged by an oven door 50 (see FIG. 1) hinged to the range at its bottom edge in the usual manner. The edge of the door or portions thereof will engage the portion 48 of the sealing member and thus provide a good seal around the oven opening when the door is closed.

Also as shown in FIG. 2, a body of heat insulating material 52 is inserted between the opposed portions of inner side panel member 4 and outer side panel member 6 only at the regions 42 to help thermally insulate those two members from each other. Thus, when the range is assembled and the parts secured together, the oven shell is substantially completely isolated from the remainder of the range structure and good thermal insulation is thus provided.

In FIG. 3, the inner panel member 4 is shown as provided with openings 54 therethrough in the region of the lower edge of that panel and openings 56 through the upper regions of that panel. These openings provide for the circulation of cooling air between the side panel members 4 and 6 to thus further insure that the outer surface of the range will be kept cool at all times.

Figure 1:
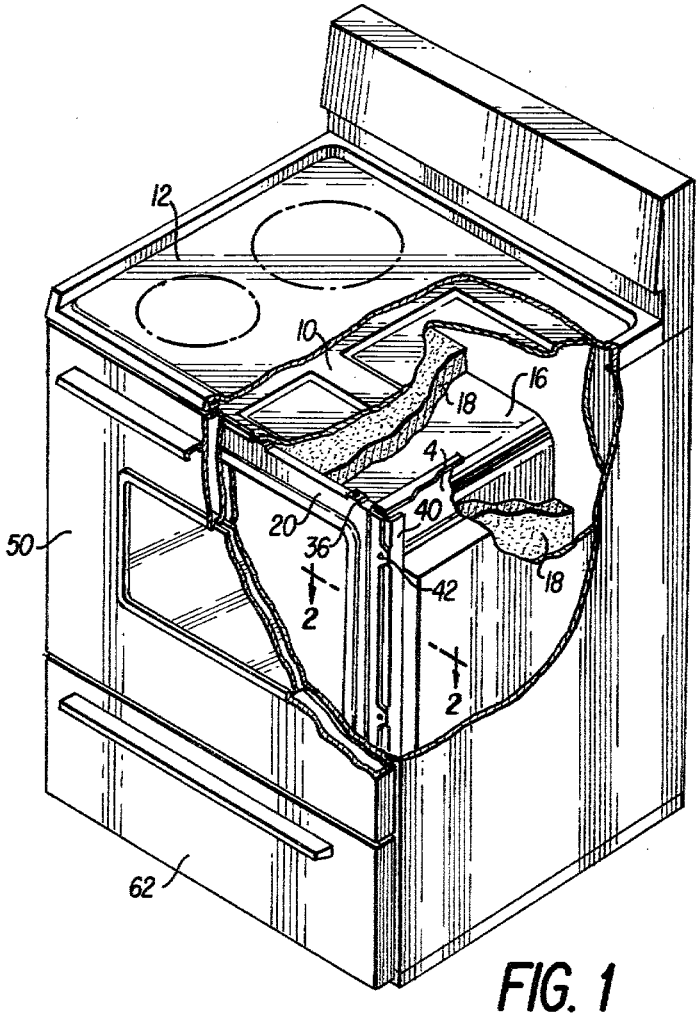
FIG. 1 is a perspective view of a representative range embodying the present invention, with parts thereof broken away.
Figure 5:
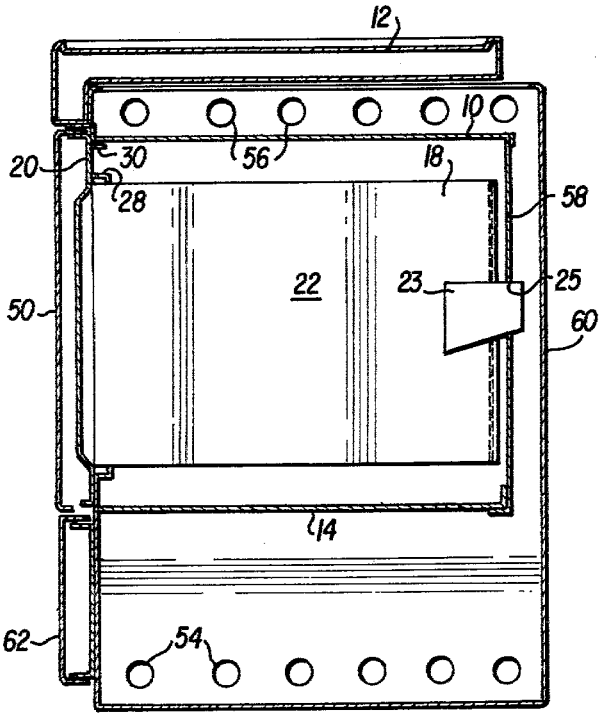
FIG. 5 is a front-to-back longitudinal and schematic sectional view through a range embodying the present invention.

While FIG. 3 shows the rear panel member 8 as being a single sheet of metal, it may well be in the nature of hollow panel comprising inner and outer sheets 58 and 60 as shown in FIG. 5. Also, it is obvious that the structure thus far described is readily adaptable to either gas or electric ranges. In the event it constitutes an electric range, the same may be provided with a storage drawer 62 as shown in FIG. 1, or that portion of a gas range may be provided with a gas broiler, not shown, but which could be mounted in much the same manner as the oven shell 16. Also, the bottom panel 14 shown in FIG. 3 is preferably provided on its upper surface with suitable thermal insulating material, not shown.

As a further feature, the basic structure thus described may be completely enclosed with outer panel or cover members if desired to change the style or appearance of the range.

While a single specific embodiment of the invention has been shown and described herein, the same is merely illustrative of the principles involved and other forms may be resorted to within the scope of the appended claims.

I claim:

1. A modular range construction comprising:

a pair of side panels comprising the main structural portions of said range;

at least one range top member secured to said side panels adjacent the tops thereof;

a range back secured to said side panels at their rear edge portions;

a bottom member, spaced downwardly from said range top member, extending between and secured to said side panels;

a separate oven front framing member positioned and secured between said side panels and extending from said range top member to said bottom member; and a thermally insulated oven shell having an open front and being spaced from and within the space defined by said side panels, range back, range top member and bottom member, said oven shell being secured to said oven front framing member.

2. A range construction as defined in claim 1 wherein said side panels are provided with means inhibiting heat transfer in an area substantially coextensive with adjacent surfaces of said oven shell.

3. A range construction as defined in claim 1 wherein said oven shell is secured to said front framing member at only spaced points adjacent its open front defined by outstanding pad portions of said oven shell through which fasteners extend, said pads comprising the only heat conducting contact between said oven shell and said oven front framing member.

4. A range construction as defined in claim 3 wherein the front peripheral edge portion of said open front of said oven shell is defined by a lateral flange extending toward but spaced from said oven front framing member, the space therebetween being occupied by a heat insulating sealing member.

5. A range construction as defined in claim 4 wherein said heat insulating sealing member has a portion overlying the outer face of said flange and defining a peripheral sealing member extending around said open front, and an oven door hinged to said range and having a peripheral portion engageable with said peripheral sealing member.

6. A range construction as defined in claim 1 wherein each of said side panels comprises an inner panel sheet of metal and a spaced outer panel sheet of metal having overlapping peripheral flanges secured together at spaced points defined by projecting pad portions through which fasteners extend.

7. A range construction as defined in claim 6 including thermal insulation material between said overlapping peripheral flanges at said spaced points.

8. A range construction as defined in claim 3 wherein said oven front framing member is secured to each of said panels at only spaced points defined by projecting pad portions through which fasteners extend.

9. A range construction as defined in claim 6 wherein at least said inner panel sheet of metal is provided with openings therethrough for the circulation of cooling air through the space between said inner and outer panel sheets.

* * * * *